US009175238B2

(12) United States Patent
Park et al.

(10) Patent No.: US 9,175,238 B2
(45) Date of Patent: Nov. 3, 2015

(54) BRAKE FLUID COMPOSITION COMPRISING TARTARIC ACID AND IMIDAZOLE

(75) Inventors: Jae Yoon Park, Seoul (KR); Chang Yeol Jo, Busan (KR); Hong Ki Lee, Gyeonggi-do (KR)

(73) Assignee: KUKDONG JEYEN COMPANY LIMITED, Gyeonggi-do (KR)

( * ) Notice: Subject to any disclaimer, the term of this patent is extended or adjusted under 35 U.S.C. 154(b) by 0 days.

(21) Appl. No.: 14/356,164

(22) PCT Filed: Jan. 31, 2012

(86) PCT No.: PCT/KR2012/000757

§ 371 (c)(1),
(2), (4) Date: May 4, 2014

(87) PCT Pub. No.: WO2013/065904

PCT Pub. Date: May 10, 2013

(65) Prior Publication Data

US 2014/0323370 A1 Oct. 30, 2014

(30) Foreign Application Priority Data

Nov. 4, 2011 (KR) ..... 10-2011-0114225

(51) Int. Cl.

| | |
|---|---|
| ***C10M 139/00*** | (2006.01) |
| ***C10M 135/32*** | (2006.01) |
| ***C10M 133/44*** | (2006.01) |
| ***C10M 107/34*** | (2006.01) |
| ***C10M 141/06*** | (2006.01) |
| ***C10M 169/04*** | (2006.01) |
| ***C23F 11/10*** | (2006.01) |
| *C10M 129/16* | (2006.01) |
| *C10M 129/36* | (2006.01) |
| *C10M 133/46* | (2006.01) |

(52) U.S. Cl.

CPC ..... *C10M 141/06* (2013.01); *C10M 169/04* (2013.01); *C23F 11/10* (2013.01); *C10M 129/16* (2013.01); *C10M 129/36* (2013.01); *C10M 133/44* (2013.01); *C10M 133/46* (2013.01); *C10M 139/00* (2013.01); *C10M 2207/04* (2013.01); *C10M 2207/0406* (2013.01); *C10M 2207/124* (2013.01); *C10M 2207/289* (2013.01); *C10M 2209/1033* (2013.01); *C10M 2209/1045* (2013.01); *C10M 2209/1085* (2013.01); *C10M 2215/042* (2013.01); *C10M 2215/223* (2013.01); *C10M 2215/224* (2013.01); *C10M 2227/00* (2013.01); *C10M 2227/061* (2013.01); *C10N 2230/08* (2013.01); *C10N 2230/10* (2013.01); *C10N 2230/12* (2013.01)

(58) Field of Classification Search

CPC ..... C10M 2227/061; C10M 2207/282; C10M 2215/22; C10M 2207/34

USPC ..... 508/198, 269, 279, 497

See application file for complete search history.

(56) References Cited

U.S. PATENT DOCUMENTS

| | | | | |
|---|---|---|---|---|
| 3,334,048 | A * | 8/1967 | Hitchcock et al. | 252/77 |
| 6,339,050 | B1 * | 1/2002 | Park | 508/198 |

FOREIGN PATENT DOCUMENTS

| | | | |
|---|---|---|---|
| EP | 0769573 | A1 | 4/1997 |
| JP | 55-129494 | A | 10/1980 |
| KR | 0187178 | B1 | 4/1999 |
| KR | 10-0600100 | B1 | 7/2006 |

OTHER PUBLICATIONS

International Search Report for PCT/KR2012/000757.

* cited by examiner

*Primary Examiner* — Vishal Vasisth
(74) *Attorney, Agent, or Firm* — The PL Law Group, PLLC

(57) ABSTRACT

The present invention relates to a brake fluid composition comprising (a) a glycol compound and boron-containing compound mixture as solvents, (b) corrosion inhibitior, (c) and tartatric acid, imidazole or a mixture of tartaric acid and imidazole as antioxidants. Provided is a brake fluid composition having improved capabilities for inhibiting thermal oxidation, metallic and high-temperature corrosion. The brake fluid composition according to the present invention significantly improves long-term durability by reducing metal dot corrosion and preventing boronic acid precipitation on a test piece, while having a superior thermal oxidation inhibition capability, and has superior capabilities for inhibiting high-temperature oxidation and corrosion while having negligible effects on the equilibrium reflux boiling point and the wet equilibrium reflux boiling point.

1 Claim, No Drawings

BRAKE FLUID COMPOSITION COMPRISING TARTARIC ACID AND IMIDAZOLE

CROSS REFERENCE TO RELATED APPLICATIONS AND CLAIM OF PRIORITY

This patent application claims benefit under 35 U.S.C. 119(e), 120, 121, or 365(c), and is a National Stage entry from International Application No. PCT/KR2012/000757, filed Jan. 31, 2012, which claims priority to Korean Patent Application No. 10-2011-0114225, filed Nov. 4, 2011, entire contents of which are incorporated herein by reference.

TECHNICAL FIELD

The present invention relates to a brake fluid composition.

BACKGROUND ART

The present invention relates to a brake fluid composition for a vehicle, which is used in a brake device for a vehicle system, the brake fluid composition containing a solvent, a metal corrosion inhibitor, and an antioxidant. More particularly, the present invention relates to a brake fluid composition for a vehicle, capable of improving the metal corrosion-inhibiting capability by containing a glycol mixture as a solvent, a mixture of triazole and thiadiazole as an anti-corrosive agent, an antioxidant, and a stabilizer.

Brake fluid plays an important role of accurately transferring the pressure generated from a master cylinder to a wheel cylinder. Problems occurring during this procedure cause deterioration in brake responsiveness. The brake fluid needs to meet several requirements associated with its chemical and physical properties. Of these, the first requirement is a high equilibrium reflux boiling point (ERBP). The brake fluid itself is difficult to boil. However, the brake fluid has a high temperature at the time of braking, and thus may boil under particular circumstances. If the brake fluid boils, the pressure of the master cylinder may not be accurately transferred, so a stable brake force cannot be expected. Meanwhile, the temperature of frictional heat caused by the frequent use of a disk brake in a brake system is about 800° C. The brake fluid receiving this high-temperature heat is thermally oxidized, resulting in degradation in the metal corrosion-inhibiting capability, causing safety accidents. The second requirement is a high wet equilibrium reflux boiling point. The brake fluid, which is a hygroscopic liquid, is required to have low hygroscopic property, but it is important to prevent the drop in the boiling point of the brake fluid even when the brake fluid absorbs moisture. The reasons are that when the brake fluid absorbs moisture in the atmosphere and thus lowers its boiling point, this may lead to vapor lock, causing safety accidents. In addition, the viscosity change of the brake fluid needs to be small even within a wide temperature range. In addition, a metal corrosion inhibitor and an oxidation stabilizer, which can inhibit the corrosion of various kinds of metals present in the braking device to enhance their durability, are added to the brake fluid.

In the case of the generally used brake fluids, only a glycol ether compound is used as a solvent, or about 30-50 wt % of a boron ester compound is added to the solvent. The brake fluid containing only the glycol ether compound absorbs moisture in the atmosphere if used for a long period of time, and thus lowers its wet boiling point, resulting in the vapor lock, causing a risk of the brake failure which may lead to an accident. Moreover, the metal corrosion-inhibiting capability of this brake fluid is poor. Also, the brake fluid with about 30-50 wt % of a boron ester compound raises its equilibrium reflux boiling point and wet boiling point by using the boron ester compound, and thus has a higher degree of safety than the brake fluid using only the glycol ether compound. However, this brake fluid may corrode metal components by a boronic acid, which is deposited due to hydrolysis of the boron ester compound when moisture is absorbed. The protection of metals and nonferrous metals against the corrosion by these brake fluids can be achieved by an additive for corrosion inhibition and an antioxidant.

SUMMARY

Therefore, the present inventors have endeavored to solve the above-mentioned problems. As a result, the present inventors have verified that a brake fluid composition further including tartaric acid, imidazole or a mixture of tartaric acid and imidazole in addition to the conventional brake fluid composition can enhance the capabilities to inhibit thermal oxidation, corrosion due to chlorine ions, high-temperature corrosion, and precipitation of boronic acid, and then have completed the present invention.

Accordingly, an aspect of the present invention is to provide a brake liquid composition.

Other purposes and advantages of the present invention will be clarified by the following detailed description of invention, claims, and drawings.

DETAILED DESCRIPTION

In accordance with an aspect of the present invention, there is provided a brake fluid composition including a glycol compound and a boron-containing compound as a solvent, a metal corrosion inhibitor, and tartaric acid, imidazole, or a mixture of tartaric acid and imidazole as an antioxidant.

The present inventors have endeavored to solve the above-mentioned problems. As a result, the present inventors have verified that a brake fluid composition further including tartaric acid, imidazole or a mixture of tartaric acid and imidazole in addition to the conventional brake fluid composition can enhance the capabilities to inhibit thermal oxidation, corrosion by chlorine ions, high-temperature corrosion, and precipitation of boronic acid, and then have completed the present invention.

As used herein, the term "brake fluid" refers to a non-petroleum-based liquid for a hydraulic brake of a vehicle, which is used for a braking device of a car (transporting vehicle), and a liquid material used to accurately transfer the pressure, which is generated from a master cylinder at the time of driving, to a wheel cylinder.

In the composition of the present invention, any glycol compound known in the art may be used as the solvent. The glycol compound is preferably selected from the group consisting of ethylene glycol, diethylene glycol, triethylene glycol, methylene glycol, dimethylene glycol, trimethylene glycol, propylene glycol, dipropylene glycol, butylene glycol, polyalkylene glycol, glycol ether, and a mixture thereof. More preferably, the glycol compound suitable for the composition of the present invention is ethylene glycol, diethylene glycol, propylene glycol, dipropylene glycol, polyalkylene glycol, or glycol ether.

In the composition of the present invention, any glycol ether known in the art may be used. Preferably, the glycol ether is selected from the group consisting of ethylene glycol ethyl ether, diethylene glycol ethyl ether, triethylene glycol ethyl ether, ethylene glycol methyl ether, diethylene glycol methyl ether, triethylene glycol methyl ether, polyethylene glycol methyl ether, ethylene glycol butyl ether, diethylene glycol butyl ether, triethylene glycol butyl ether, polyethylene glycol butyl ether, dipropylene glycol methyl ether, polypropylene glycol methyl ether, and a mixture thereof. More preferably, the glycol ether suitable for the composition of the present invention is ethylene glycol methyl ether, diethylene glycol methyl ether, triethylene glycol methyl ether, polyethylene glycol methyl ether, ethylene glycol butyl ether, diethylene glycol butyl ether, triethylene glycol butyl ether, or polyethylene glycol butyl ether. Most preferably, the glycol ether is triethylene glycol mono-methyl ether, polyethylene glycol mono-methyl ether, or polyethylene glycol mono-butyl ether.

In the composition of the present invention, the brake fluid composition of the present invention includes a boron-containing compound. Preferably, the boron-containing compound is selected from the group consisting of boron, a boron compound, sodium borate, and potassium borate. The boron-containing compound is more preferably a boron compound, and still more preferably a boron ester compound. Most preferably, the boron-containing compound is tris[2-[2-(2-methoxyethoxy)ethoxy]ethyl]orthoborate.

According to a more preferable embodiment of the present invention, the solvent used herein is a mixture of polyalkylene glycol, glycol ether, and a borate ester compound.

In the composition of the present invention, the content of the solvent is preferably 20-99 wt %, more preferably 40-99 wt %, still more preferable 60-95 wt %, still more preferably 70-95 wt %, and most preferably 85-95 wt %, based on the total weight of the composition.

When the polyalkylene glycol, glycol ether, and borate ester are used as a solvent, the content of polyalkylene glycol is preferably 1.0-80 wt %, more preferably 1.0-60 wt %, still more preferably 5.0-50 wt %, and still more preferably 5.0-30 wt %, based on the total weight of the solvent. The content of glycol ether is preferably 20-90 wt %, more preferably 50-90 wt %, still more preferably 60-80 wt %, and still more preferably 70-85 wt %, based on the total weight of the solvent. The content of borate ester is preferably 0.1-70 wt %, more preferably 0.1-60 wt %, still more preferably 1.0-50 wt %, and still more preferably 1.0-30 wt %, based on the total weight of the solvent.

The metal corrosion inhibitor of the present invention includes various metal corrosion inhibitors known in the art. According to a preferable embodiment of the present invention, the corrosion inhibitor used in the present invention is triazole, an amine compound, or a mixture thereof.

The triazole usable herein includes various triazole compounds known in the art. The triazole is preferably selected from the group consisting of benzotriazole, tolyltriazole, octyltriazole, decyltriazole, dodecyltriazole, and a mixture thereof. More preferably, the triazole usable herein is bentriazole or tolyltriazole.

In the composition of the present invention, the preferable content of the triazole as a metal corrosion inhibitor is 0.1-10 wt %, and more preferably 0.5-5.0 wt %, based on the total weight of the composition.

The amine compound usable herein is selected from alkyl diethanol amine (e.g., methyl diethanol amine), monoethanol amine, diethanol amine, triethanol amine, cyclohexyl amine, morpholine, phenyl morpholine, ethanol amine, di-(2-ethylhexyl) amine, di-N-butyl amine, monoamyl amine, diamyl amine, dioctyl amine, salicyl monoethanol amine, and di-beta-naphthyl-p-phenylene diamine. Most preferably, the amine compound useable herein is cyclohexyl amine or alkyl diethanol amine.

In the composition of the present invention, the preferable content of the amine compound as a metal corrosion inhibitor is 0.1-10 wt %, and more preferably 0.5-10 wt %, based on the total weight of the composition.

The brake fluid composition of the present invention necessarily includes, as an antioxidant, tartaric acid, imidazole, or a mixture of tartaric acid and imidazole. As validated in the following examples, the tartaric acid, imidazole, or mixture of tartaric acid and imidazole exhibits very excellent performance in thermal oxidation inhibition and durability.

The imidazole usable herein includes various imidazoles known in the art. Preferably, the imidazole is one or more imidazole compounds selected from the group consisting of 1H-imidazole, 1-methylimidazole, 1-ethylimidazole, 1-(β-hydroxyethyl)imidazole, 1,2-dimethylimidazole, 1-phenylimidazole, benzimidazole, N-vinylimidazole, and 2-mercapto-1-methylimidazole. Most preferably, the imidazole is 1H-imidazole.

In the composition of the present invention, the preferable content of the mixture of tartaric acid and imidazole as an antioxidant is 0.1-10 wt % and more preferably 0.5-5.0 wt %, based on the total weight of the composition. In the mixture of tartaric acid and imidazole as an antioxidant, the preferable weight ratio of two components, tartaric acid:imidazole is 0.1:1 to 1:0.1.

In the brake fluid composition of the present invention, which includes a mixture of a glycol compound and a borate ester compound, a corrosion inhibitor, and tartaric acid, imidazole, or a mixture of tartaric acid and imidazole as an antioxidant, the preferable contents are 85-99 wt % for the mixture of a glycol compound and a borate ester compound, 0.5-10.0 wt % for the corrosion inhibitor, and 0.5-5.0 wt % for tartaric acid, imidazole, or the mixture of tartaric acid and imidazole as an antioxidant.

The brake fluid composition of the present invention has excellent performance in long-term metal corrosion inhibition and thermal oxidation inhibition. Therefore, the brake fluid composition of the present invention enhanced the capability to inhibit thermal oxidation and corrosive durability, and solved the problem in which the brake fluid boils at high temperature, by adding the antioxidant differentiated from the conventional antioxidant. Further, the brake fluid composition of the present invention inhibited corrosion by chlorine ions and neighboring metal component corrosion due to precipitation of boric acid.

Features and advantages of the present invention are summarized as follows:

(a) The brake fluid composition of the present invention is characterized by using tartaric acid, imidazole, or a mixture of tartaric acid and imidazole, as a differentiated antioxidant, and including a corrosion inhibitor.

(b) The present invention provides a brake fluid composition having enhanced performance in thermal oxidation inhibition, metal corrosion inhibition, and high-temperature corrosion inhibition.

(c) The brake fluid composition of the present invention reduces metal pitting corrosion of specimens and inhibits the precipitation of boronic acid while has excellent resistance to thermal oxidation corrosion, thereby exhibiting significantly enhanced long-term durability by reducing metal pitting corrosion of specimens and inhibiting precipitation of boronic acid, while having excellent resistance to thermal oxidation corrosion, and has very excellent performance in high-temperature oxidation inhibition and corrosion inhibition while having very little influence on the equilibrium reflux boiling point and the wet equilibrium reflux boiling point.

Hereinafter, the present invention will be described in detail with reference to examples. These examples are only for illustrating the present invention more specifically, and it will be apparent to those skilled in the art that the scope of the present invention is not limited by these examples.

EXAMPLES

Preparative Example

Brake fluid compositions of the present invention having the following compositions as shown in Table 1 were prepared.

TABLE 1

| Function | Composition (wt %) | Example 1 | Example 2 | Example 3 | Example 4 | Comparative Example 1 | Comparative Example 2 |
|---|---|---|---|---|---|---|---|
| Solvent | Polyalkylene glycol | 17 | 17 | 5 | 5 | 17 | 5 |
| | Polyethylene glycol monomethyl ether | 23 | 23 | 15 | 14 | 23 | 14 |
| | Polyethylene glycol monobutyl ether | 24 | 24 | 21 | 13 | 24 | 13 |
| | Triethylene glycol monomethyl ether | 33.6 | 33.6 | 24 | 13 | 33.6 | 13 |
| | Borate ester compound | — | — | 32.6 | 52.6 | — | 52.6 |
| Metal corrosion inhibitor | Benzotriazole | 0.6 | 0.6 | — | — | 0.6 | — |
| | Tolyltriazole | — | — | 0.6 | 0.6 | — | 0.6 |
| | Alkyl diethanol amine | 1.0 | — | 1. 0 | — | — | — |
| | Cyclohexyl amine | — | 1.0 | — | 1.0 | — | |
| Antioxidant | Triethanol amine | | — | — | — | 1.0 | 1.0 |
| | Tartaric acid | 0.8 | — | 0.4 | 0.4 | — | — |
| | Imidazole | — | 0.8 | 0.4 | 0.4 | — | — |
| | Dibutyl hydroxy toluene | — | — | — | — | 0.8 | 0.8 |

Respective brake fluid compositions of examples and comparative examples were prepared according to the compositions shown in Table 1. The borate ester compound was tris [2-[2-(2-methoxyethoxy)ethoxy]ethyl]orthoborate, and the imidazole is 1H-imidazole. Here, respective components for each composition were stirred and mixed at room temperature (25° C.) for 1 hour, and then filtered by microfiltration (5 μm).

Experimental Examples

The performance of the brake fluid compositions (Table 1) of the examples and comparative examples was evaluated by conducting tests on thermal oxidation, metal corrosion by chlorine ions, high-temperature metal corrosion, antioxidation, equilibrium reflux boiling point, wet equilibrium reflux boiling point, and precipitation of boronic acid, and then the test results were shown in Tables 2 to 7.

TABLE 2

| Test on thermal oxidation for respective compositions (132° C. × 18 hr × copper powder 2 g × bubbles 120 ml/min) | | | | | | | |
|---|---|---|---|---|---|---|---|
| Classification | | Example | Example | Example | Example | Comparative | Comparative |
| Item | Standard | 1 | 2 | 3 | 4 | Example 1 | Example 2 |
| Thermal oxidation test (%) | Change in reserve alkalinity Max. 20% | 14% | 16% | 15% | 16% | 70% | 85% |
| Change in pH | — | 0.5 | 0.6 | 0.5 | 0.5 | 2.2 | 2.5 |

In order to evaluate the excellence of the brake fluid with respect to thermal oxidation, the following test was conducted. For the promotion of thermal oxidation, a copper powder and bubbles were injected. 50 ml of a brake fluid and 2 g of a copper powder were put in a 250 ml Erlenmeyer flask, and then the preparation for the test was made using an air tube, a cooler, and a thermometer. The bubbles were injected through the air tube at a rate of 120 ml/min, and the brake fluid was stirred 132° C. for 18 hours, followed by cooling. After that, the reserve alkalinity of the brake fluid was measured, and then the change in reserve alkalinity between before the test and after the test was confirmed through comparison.

As a result of the test on thermal oxidation, as can be seen in Table 2, the brake fluids using tartaric acid, imidazole, or a mixture of tartaric acid and imidazole were about 4-6 times better than the comparative examples (i.e., brake fluids not containing tartaric acid, imidazole, or a mixture of tartaric acid and imidazole) in terms of the change in reserve alkalinity. Also, the brake fluids using tartaric acid, imidazole, or a mixture of tartaric acid and imidazole were about 4-5 times better than the comparative examples in terms of the change in pH. This indicated that the tartaric acid, imidazole, or mixture of tartaric acid and imidazole effectively inhibited the oxidation of the brake fluid due to heat.

TABLE 3

Test on metal corrosion due to chlorine ions for respective compositions (100° C. × 120 hr × moisture 5%, NaCl 25 ppm addition)

| Classification | | | Example | Example | Example | Example | Comparative | Comparative |
|---|---|---|---|---|---|---|---|---|
| Item | Standard | | 1 | 2 | 3 | 4 | example 1 | example 2 |
| Test on corrosion by chlorine ions ($mg/cm^2$) | Tin plate | ±0.2 | 0.02 | 0.02 | 0.01 | 0.01 | 0.06 | 0.12 |
| | Steel | ±0.2 | 0.02 | 0.02 | 0.04 | 0.03 | 0.08 | 0.14 |
| | Aluminum | ±0.1 | 0.02 | 0.01 | 0.01 | 0.01 | 0.25 | 0.37 |
| | Cast iron | ±0.2 | 0.02 | 0.02 | 0.02 | 0.05 | 0.11 | 0.12 |
| | Brass | ±0.4 | 0.05 | 0.06 | 0.05 | 0.02 | 0.49 | 0.63 |
| | Copper | ±0.4 | 0.04 | 0.08 | 0.04 | 0.03 | 0.55 | 0.65 |
| | Zinc | ±0.4 | 0.06 | 0.06 | 0.05 | 0.07 | 0.35 | 0.42 |
| Appearance | Should have no corrosion | | Good | Good | Good | Good | Aluminum pitting corrosion | Aluminum pitting corrosion |

In order to evaluate the excellence of the brake fluid with respect to corrosion by chlorine ions, the following test was conducted. The test on metal corrosion by chlorine ions was conducted according to the standard KS M 2141. For the promotion of corrosion by the brake fluid, 25 ppm of chlorine ions were added. Each brake fluid was put in a test container of a non-petroleum-based brake fluid for a vehicle. The temperature was controlled to be 100° C., and then a standard test specimen was immersed for 120 hours.

As a result of the test on metal corrosion by chlorine ions, as can be seen in Table 3, the brake fluids using tartaric acid, imidazole, or a mixture of tartaric acid and imidazole were at least 10 times better than the comparative examples in terms of the corrosion inhibition capability of the brake fluid. Also, as for the evaluation of the degree of appearance corrosion, aluminum pitting corrosion occurred when aluminum was exposed to chlorine ions in the comparative examples (brake fluids not containing tartaric acid, imidazole, or a mixture of tartaric acid and imidazole). This indicated that the tartaric acid, imidazole, or mixture of tartaric acid and imidazole enhanced the capability of the brake fluid to inhibit metal corrosion against chlorine ions.

TABLE 4

Test on high-temperature metal corrosion for respective compositions (120° C. × 120 hr)

| Classification | | | Example | Example | Example | Example | Comparative | Comparative |
|---|---|---|---|---|---|---|---|---|
| Item | Standard | | 1 | 2 | 3 | 4 | Example 1 | Example 2 |
| High-temperature metal corrosion test ($mg/cm^2$) | Tin plate | ±0.2 | 0.01 | 0.02 | 0.01 | 0.02 | 0.08 | 0.09 |
| | Steel | ±0.2 | 0.02 | 0.02 | 0.02 | 0.03 | 0.11 | 0.11 |
| | Aluminum | ±0.1 | 0.01 | 0.01 | 0.03 | 0.02 | 0.20 | 0.20 |
| | Cast iron | ±0.2 | 0.02 | 0.01 | 0.02 | 0.03 | 0.11 | 0.13 |
| | Brass | ±0.4 | 0.03 | 0.02 | 0.03 | 0.03 | 0.20 | 0.22 |
| | Copper | ±0.4 | 0.03 | 0.04 | 0.05 | 0.05 | 0.18 | 0.20 |
| | Zinc | ±0.4 | 0.04 | 0.04 | 0.05 | 0.06 | 0.35 | 0.41 |

In order to evaluate the excellence of the brake fluid with respect to high-temperature durability, the following test was conducted. The test on high-temperature metal corrosion was conducted according to the standard MS M 2141, and the results at 120° C. after 120 hours were observed.

As a result of the test on high-temperature metal corrosion, as can be seen in Table 4, the brake fluids containing tartaric acid, imidazole, or a mixture of tartaric acid and imidazole were at least about 5 times better than the comparison examples (i.e., brake fluids not containing tartaric acid, imidazole, or a mixture of tartaric acid and imidazole) in terms of the metal weight change in the evaluation on high-temperature metal corrosion. This indicated that the tartaric acid, imidazole, or mixture of tartaric acid and imidazole enhanced the capability of the brake fluid to inhibit metal corrosion against high temperature.

TABLE 5

Test on antioxidation for respective compositions (23° C. × 70 hr + 70° C. × 168 hr)

| Classification | | | Example 1 | Example 2 | Example 3 | Example 4 | Comparative Example 1 | Comparative Example 2 |
|---|---|---|---|---|---|---|---|---|
| Item | Standard | | | | | | | |
| Antioxidation ($mg/cm^2$) | Aluminum | ±0.05 | 0.01 | 0.01 | 0.01 | 0.01 | 0.03 | 0.03 |
| | Cast iron | ±0.3 | 0.02 | 0.02 | 0.02 | 0.01 | 0.19 | 0.21 |

In order to evaluate the excellence of the brake fluid with respect to antioxidation, the following test was conducted. The test on antioxidation was conducted according to the procedure KS M2141 5.9. After metal specimens were subjected to the test at 23° C. for 70 hours and then allowed to stand at 70° C. for 168 hours, appearances and weight changes of metal specimens were measured. The test is to evaluate the corrosion inhibition performance by adding benzoyl peroxide and rubber to the brake fluid. External surfaces of aluminum and cast iron specimens, which are brought into contact with a thin plate, should not be corroded to such an extent as to be observable to the naked eye.

As can be seen in Table 5, the brake fluids containing tartaric acid, imidazole, or a mixture of tartaric acid and imidazole in examples were at least about 2 times better than the comparison examples (i.e., brake fluids not containing tartaric acid, imidazole, or a mixture of tartaric acid and imidazole) in terms of antioxidation against benzoyl peroxide. This indicated that the tartaric acid, imidazole, or mixture of tartaric acid and imidazole enhanced the antioxidation of the brake fluid.

TABLE 6

Tests on equilibrium reflux boiling point and wet equilibrium reflux boiling point test for respective compositions

| Classification | | | | | | | | |
|---|---|---|---|---|---|---|---|---|
| | Standard | | | | | | | |
| Item | 3 specimens | 4 specimens | Example 1 | Example 2 | Example 3 | Example 4 | Comparative Example 1 | Comparative Example 2 |
| Equilibrium reflux boiling point | 205° C. or higher | 230° C. or higher | 251 | 251 | 261 | 271 | 251 | 271 |
| Wet equilibrium reflux boiling point | 140° C. or higher | 155° C. or higher | 149 | 150 | 160 | 172 | 149 | 172 |

In order to evaluate the excellence of the brake fluid with respect to the equilibrium reflux boiling point and wet equilibrium reflux boiling point, the following tests were conducted. Tests on equilibrium reflux boiling point and wet equilibrium reflux boiling point were conducted according to the procedures of KS M2141 5.1.1 and 5.1.4. As a result of the tests on equilibrium reflux boiling point and wet equilibrium reflux boiling point, as can be seen in Table 6, all the specimens showed equivalent levels of result values. This indicated that the equilibrium reflux boiling point and wet equilibrium reflux boiling point are not significantly influenced by the kind of additives in the composition of the present invention.

TABLE 7

| Test on precipitation of boronic acid for respective compositions | | | | | | | |
|---|---|---|---|---|---|---|---|
| Classification | | Example | Example | Example | Example | Comparative | Comparative |
| Item | Standard | 1 | 2 | 3 | 4 | Example 1 | Example 2 |
| Test on precipitation of boronic acid | Should have no precipitation and foreign particles | No | No | No | No | Precipitation of boronic acid | Precipitation of boronic acid |

In order to evaluate the excellence of the brake fluid with respect to the precipitation of boronic acid, the following tests were conducted. The brake fluid was injected into a flask, and after 72 hours, the precipitation of boronic acid was observed by the hand or naked eye. As a result of the test on precipitation of boronic acid precipitation, as can be seen in Table 7, the boronic acid was not precipitated even after 72 hours in the brake fluids using alkyl diethanol amine or cyclohexyl amine. However, the boronic acid was precipitated in the comparative examples (i.e., brake fluids not containing tartaric acid, imidazole, or a mixture of tartaric acid and imidazole) after 72 hours. This indicated that the alkyl diethanol amine or cyclohexyl amine enhanced the capability of the brake fluid to inhibit the precipitation of boronic acid.

The invention claimed is:

1. A brake fluid composition comprising:

(a) 85-99 wt % of a glycol compound and a boron-containing compound as a solvent;

(b) 0.5-10.0 wt % of a corrosion inhibitor; and (c) 0.5-5.0 wt % of a mixture of tartaric acid and imidazole as an antioxidant;

wherein the glycol compound as the solvent is comprised with 5.0-30 wt % of polyalkylene glycol and 60-85 wt % of glycol ether, based on the total weight of the solvent;

wherein the glycol ether is one or more selected from the group consisting of triethylene glycol mono-methyl ether, polyethylene glycol mono-methyl ether and polyethylene glycol mono-butyl ether;

wherein the boron-containing compound as a solvent is included with 1.0-30 wt % of tris[2-[2-(2-methoxyethoxyl)ethoxy]ethyl]orthoborate, based on the total weight of the solvent;

wherein the corrosion inhibitor is a mixture of tolyltriazole and an amine compound; and wherein the amine compound is alkyl diethanol amine or cyclohexyl amine.

* * * * *